US008368504B1

(12) United States Patent
Chen et al.

(10) Patent No.: US 8,368,504 B1
(45) Date of Patent: Feb. 5, 2013

(54) POSITIVE TEMPERATURE COEFFICIENT CIRCUIT PROTECTION DEVICE

(75) Inventors: Jack Jih-Sang Chen, New Taipei (TW); Chi-Hao Gu, New Taipei (TW)

(73) Assignee: Fuzetec Technology Co., Ltd., Taipei County (TW)

( * ) Notice: Subject to any disclaimer, the term of this patent is extended or adjusted under 35 U.S.C. 154(b) by 0 days.

(21) Appl. No.: 13/240,692

(22) Filed: Sep. 22, 2011

(51) Int. Cl.
*H01C 7/10* (2006.01)

(52) U.S. Cl. ..... 338/22 R; 338/13; 252/511; 252/514; 428/210

(58) Field of Classification Search ..... 338/22 R
See application file for complete search history.

(56) References Cited

U.S. PATENT DOCUMENTS 5,747,147 A * 5/1998 Wartenberg et al. ..... 428/209
5,801,612 A * 9/1998 Chandler et al. ..... 338/22 R
5,880,668 A * 3/1999 Hall ..... 338/22 R
6,570,483 B1 * 5/2003 Chandler et al. ..... 338/22 R
6,828,362 B1 * 12/2004 Lee et al. ..... 524/47
6,987,440 B2 * 1/2006 Becker et al. ..... 338/22 R
7,041,238 B2 * 5/2006 Kim et al. ..... 252/511

* cited by examiner

*Primary Examiner* — Kyung Lee
(74) *Attorney, Agent, or Firm* — Foley & Lardner LLP

(57) ABSTRACT

A PTC circuit protection device includes a PTC polymer material and two electrodes attached to the PTC polymer material. The PTC polymer material includes a polymer matrix and a particulate conductive filler dispersed in the polymer matrix. The polymermatrix is made from a polymer composition that contains a primary polymer unit and a reinforcing polyolefin. The primary polymer unit contains a base polyolefin and optionally a grafted polyolefin. The reinforcing polyolefin has a weight average molecular weight greater than that of the base polyolefin. The primary polymer unit and the reinforcing polyolefin are co-melted together and then solidified to form the polymer matrix. The base polyolefin has a melt flow rate ranging from 10 g/10 min to 100 g/10 min, and the reinforcing polyolefin has a melt flow rate ranging from 0.01 g/10 min to 1 g/10 min.

9 Claims, 6 Drawing Sheets

POSITIVE TEMPERATURE COEFFICIENT CIRCUIT PROTECTION DEVICE

BACKGROUND OF THE INVENTION

1. Field of the Invention

This invention relates to a positive temperature coefficient (FTC) circuit protection device, more particularly to a FTC circuit protection device including a polymer matrix formed from a co-melted mixture of a base polyolefin and a reinforcing polyolefin.

2. Description of the Related Art

A positive temperature coefficient (PTC) element exhibits a PTC effect that renders the same to be useful as a circuit protecting device, such as a resettable fuse. The PTC element includes a PTC polymer material and first and second electrodes attached to two opposite surfaces of the PTC polymer material. The PTC polymer material includes a polymer matrix that contains a crystalline region and a non-crystalline region, and a particulate conductive filler dispersed in the non-crystalline region of the polymer matrix and formed into a continuous conductive path for electrical conduction between the first and second electrodes. The PTC effect is a phenomena that when the temperature of the polymer matrix is raised to its melting point, crystals in the crystalline region start melting, which results in generation of a new non-crystalline region. As the new non-crystalline region is increased to an extent to merge into the original non-crystalline region, the conductive path of the particulate conductive filler will become discontinuous and the resistance of the PTC polymer material will sharply increase, thereby resulting in an electrical disconnection between the first and second electrodes.

Conventionally, the polymer matrix is made from a polymer composition containing a base high density polyethylene (HDPE) having a weight average molecular weight ranging from 50,000 g/mole to 300,000 g/mole and a melt flow rate ranging from 0.01 g/10 min to 10 g/10 min according to ASTM D-1238 under 190° C. and a load of 2.16 Kg, and optionally a carboxylic acid anhydride grafted HDPE having a weight average molecular weight ranging from 50,000 g/mole to 200,000 g/mole and a melt flow rate ranging from 0.5 g/10 min to 10 g/10 min according to ASTM D-1238 under 190° C. and a load of 2.16 Kg. The grafted HDPE serves to increase adhesion of the PTC polymer material to the electrodes.

Examples of the particulate conductive filler are carbon black, metal powders, conductive ceramic powders, metalized glass beads, etc. Since carbon black has a lower conductivity, the PTC polymer materials using carbon black as the particulate conductive filler will have a resistivity greater than 0.1 ohm-cm at room temperature. Hence, for PTC circuit protection devices that require the PTC polymer materials to have a resistivity less than 0.1 ohm-cm or even less 0.05 ohm-cm, carbon black is no longer suitable for use as the particulate conductive filler. Although the conductivity of the PTC polymer material can be considerably increased by using the non-carbon particulate conductive fillers, such as metal powders, these highly conductive non-carbon particulate conductive fillers tend to result in undesired generation of electric arc within the PTC polymer material during use. The electric arc thus formed can deteriorate the molecular structure of the polymermatrix of the PTC polymer material, which can result in an unstable electrical property of the PTC element and a decrease in the service life of the PTC element. Hence, there is a need to improve the conductivity of the PTC polymer material without resulting in deterioration of the PTC polymer material.

SUMMARY OF THE INVENTION

Therefore, an object of the present invention is to provide a PTC circuit protection device that can overcome the aforesaid drawback associated with the prior art.

According to this invention, there is provided a PTC protection device that comprises a PTC polymer material and two electrodes attached to the PTC polymer material. The PTC polymer material includes a polymer matrix and a particulate conductive filler dispersed in the polymer matrix and having a resistivity lower than that of carbon black. The polymer matrix is made from a polymer composition that contains at least a primary polymer unit and a reinforcing polyolefin. The primary polymer unit contains a base polyolefin and optionally a grafted polyolefin. The reinforcing polyolefin has a weight average molecular weight greater than that of the base polyolefin. The primary polymer unit and the reinforcing polyolefin are co-melted together and then solidified to form the polymer matrix. The base polyolefin has a melt flow rate ranging from 10 g/10 min to 100 g/10 min measured according to ASTM D-1238 under a temperature of 230° C. and a load of 12.6 Kg, and the reinforcing polyolefin has a melt flow rate ranging from 0.01 g/10 min to 1 g/10 min measured according to ASTM D-1238 under a temperature of 230° C. and a load of 12.6 Kg. The primary polymer unit is in an amount ranging from 50 to 95 wt % based on the weight of the polymer composition, and the reinforcing polyolefin is in an amount ranging from 5 to 50 wt % based on the weight of the polymer composition.

BRIEF DESCRIPTION OF THE DRAWINGS

In drawings which illustrate an embodiment of the invention.

DETAILED DESCRIPTION OF THE PREFERRED EMBODIMENT

Figure 1:
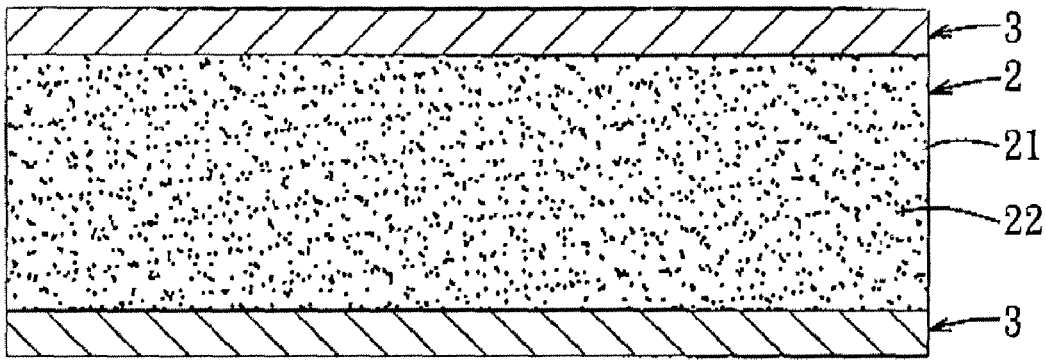
FIG. 1 is a schematic view of the preferred embodiment of a PTC circuit protection device according to this invention.

FIG. 1 illustrates the preferred embodiment of a PTC circuit protection device according to this invention. The ETC circuit protection device comprises a PTC polymer material 2 and two electrodes 3 attached to the PTC polymer material 2. The ETC polymer material 2 includes a polymer matrix 21 and a particulate conductive filler 22 dispersed in the polymer matrix 21 and having a resistivity lower than that of carbon black. The polymer matrix 21 is made from a polymer composition that contains at least a primary polymer unit and a reinforcing polyolefin. The primary polymer unit contains a base polyolefin and optionally a grafted polyolefin. The reinforcing polyolefin has a weight average molecular weight greater than that of the base polyolefin. The primary polymer unit and the reinforcing polyolefin are co-melted together and then solidified to form the polymer matrix 21. The base polyolefin has a melt flow rate ranging from 10 g/10 min to 100 g/10 min measured according to ASTM D-1238 under a temperature of 230° C. and a load of 12.6 Kg, and the reinforcing polyolefin has a melt flow rate ranging from 0.01 g/10 min to 1 g/10 min measured according to ASTM D-1238 under a temperature of 230° C. and a load of 12.6 Kg. The primary polymer unit is in an amount ranging from 50 to 95 wt % based on the weight of the polymer composition, and the reinforcing polyolefin is in an amount ranging from 5 to 50 wt % based on the weight of the polymer composition. Preferably, the amount of the primary polymer unit ranges from 75 to 95 wt % based on the weight of the polymer composition and the amount of the reinforcing polyolefin ranges from 5 to 25 wt % based on the weight of the polymer composition.

Preferably, the reinforcing polyolefin is in an amount ranging from 0.5 to 10 wt % based on the weight of the PTC polymer material 2, the primary polymer unit is in an amount ranging from 5 to 20 wt % based on the weight of the PTC polymer material 2, and the particulate conductive filler 22 is in an amount ranging from 70 to 90 wt % based on the weight of the PTC polymer material 2. More preferably, the reinforcing polyolefin is in an amount ranging from 0.5 to 6 wt % based on the weight of the PTC polymer material 2, the primary polymer unit is in an amount ranging from 9 to 18 wt % based on the weight of the PTC polymer material 2, and the particulate conductive filler 22 is in an amount ranging from 76 to 90 wt % based on the weight of the PTC polymer material 2.

Preferably, the base polyolefin and the reinforcing polyolefin are high density polyethylene (HDPE), and the grafted polyolefin is carboxylic acid anhydride grafted HDPE. The grafted polyolefin serves to increase adhesion of the PTC polymer material 2 to the electrodes 3.

Preferably, the weight average molecular weight of the base polyolefin ranges from 50,000 g/mole to 300,000 g/mole, and the weight average molecular weight of the reinforcing polyolefin ranges from 600,000 g/mole to 1,500,000 g/mole.

Preferably, the particulate conductive filler 22 is made from a material selected from a group consisting of titanium carbide, zirconium carbide, vanadium carbide, niobium carbide, tantalum carbide, chromium carbide, molybdenum carbide, tungsten carbide, titanium nitride, zirconium nitride, vanadium nitride, niobium nitride, tantalum nitride, chromium nitride, titanium disilicide, zirconium disilicide, niobium disilicide, tungsten disilicide, gold, silver, copper, aluminum, nickel, nickel-metallized glass beads, nickel-metallized graphite, Ti—Ta solid solution, W—Ti-Ta—Cr solid solution, W—Ta solid solution, W—Ti-Ta—Nb solid solution, W—Ti-Ta solid solution, W—Ti solid solution, Ta—Nb solid solution, and combinations thereof. More preferably, the particulate conductive filler 22 is made from nickel or titanium disilicide.

The following examples and comparative examples are provided to illustrate the preferred embodiment of the invention, and should not be construed as limiting the scope of the invention.

EXAMPLE

Example 1 (E1)

2 grams of HDPE (purchased fromTicona company, catalog no.: GHR8110, having a weight average molecular weight of 600,000 g/mole and a melt flow rate of 0.96 g/10 min according to ASTM D-1238 under a temperature of 230° C. and a load of 12.6 Kg) serving as the reinforcing polyolefin, 19 grams of HDPE (purchased from Formosa plastic Corp., catalog no.; HDPE9002, having a weight average molecular weight of 150,000 g/mole and a melt flow rate of 45 g/10 min according to ASTM D-1238 under a temperature of 230° C. and a load of 12.6 Kg) serving as the base polyolefin, 19 grams of carboxylic acid anhydride grafted HDPE (purchased from Dupont, catalog no.: MB100D, having a weight average molecular weight of 80,000 g/mole and a melt flow rate of 75 g/10 min according to ASTM D-1238 under a temperature of 230° C. and a load of 12.6 Kg) serving as the grated polyolefin, and 160 grams of nickel powder (purchased from Novamet Specialty Products, catalog no.: N525) serving as the particulate conductive filler 22 were compounded in a Brabender mixer. The compounding temperature was 200° C., the stirring rate was 50 rpm, the applied pressure was 5 Kg, and the compounding time was 10 minutes. The compounded mixture was hot pressed so as to form a thin sheet of the PTC polymer material 2 having a thickness of 0.12 mm. The hot pressing temperature was 200° C., the hot pressing time was 4 minutes, and the hot pressing pressure was 80 kg/cm$^2$. Two copper foil sheets were attached to two sides of the thin sheet and were hot pressed under 200° C. and 80 kg/cm$^2$ for 4 minutes to form a sandwiched structure of a PTC laminate. The PTC laminate was cut into a plurality of test samples (i.e., the PTC circuit protection devices) with a size of 4.5 mm×3.2 mm. The electrical property of the test samples was determined (as shown in Table 1). In Table 1, PE/m-PE represents the base polyolefin and the grafted polyethylene of the primary polymer unit and V-R represents the volume resistivity (ohm-cm). The PTC polymer material 2 thus formed has a composition containing 1 wt % reinforcing polyolefin, 19 wt % primary polymer unit (the weight ratio of the base polyolefin to the grafted polyolefin is 1:1) and 80 wt % particulate conductive filler 22. In addition, the polymer matrix 21 thus formed has a polymer composition containing 95 wt % of the primary polymer unit and 5 wt % of the reinforcing polyolefin.

TABLE 1

| | Reinforcing polyolefin | | Primary polymer unit | | Particulate conductive filler | | Measured property | | Polymer matrix | |
|---|---|---|---|---|---|---|---|---|---|---|
| | Catalog | | | | Catalog | | Resist., | V-R, | Reinforcing polyolefin | Primary polymer |
| sample | no. | wt % | | wt % | no. | wt % | ohm | ohm-cm | wt % | unit |
| E1 | GHR8110 | 1 | PE/m-PE | 19 | N525 | 80 | 0.00121 | 0.00917 | 5 | 95 |
| E2 | GHR8110 | 2 | PE/m-PE | 18 | N525 | 80 | 0.00108 | 0.00819 | 10 | 90 |
| E3 | GHR8110 | 3 | PE/m-PE | 17 | N525 | 80 | 0.00110 | 0.00834 | 15 | 85 |
| E4 | GHR8110 | 4 | PE/m-PE | 16 | N525 | 80 | 0.00105 | 0.00796 | 20 | 80 |
| E5 | GHR8110 | 5 | PE/m-PE | 15 | N525 | 80 | 0.00106 | 0.00803 | 25 | 75 |
| E6 | GHR8110 | 6 | PE/m-PE | 14 | N525 | 80 | 0.00108 | 0.00819 | 30 | 70 |
| E7 | GHR8110 | 7 | PE/m-PE | 13 | N525 | 80 | 0.00110 | 0,00834 | 35 | 65 |
| E8 | GHR8110 | 8 | PE/m-PE | 12 | N525 | 80 | 0.00118 | 0.00894 | 40 | 60 |
| E9 | GHR8110 | 9 | PE/m-PE | 11 | N525 | 80 | 0.00128 | 0.00970 | 45 | 55 |
| E10 | GHR8110 | 10 | PE/m-PE | 10 | N525 | 80 | 0.00146 | 0.01107 | 50 | 50 |
| E11 | GUR4012 | 1 | PE/m-PE | 19 | N525 | 80 | 0.00123 | 0.00932 | 5 | 95 |
| E12 | GUR4012 | 2 | PE/m-PE | 18 | N525 | 80 | 0.00113 | 0.00856 | 10 | 90 |
| E13 | GUR4012 | 3 | PE/m-PE | 17 | N525 | 80 | 0.00114 | 0.00864 | 15 | 85 |
| E14 | GUR4012 | 4 | PE/m-PE | 16 | N525 | 80 | 0.00111 | 0.00841 | 20 | 80 |
| E15 | GUR4012 | 5 | PE/m-PE | 15 | N525 | 80 | 0.00116 | 0.00879 | 25 | 75 |
| E16 | GUR4012 | 6 | PE/m-PE | 14 | N525 | 80 | 0.00112 | 0.00849 | 30 | 70 |
| E17 | GHR8110 | 1 | PE/m-PE | 19 | $TiSi_2$ | 180 | 0.00365 | 0.02766 | 5 | 95 |
| E18 | GHR8110 | 2 | PE/m-PE | 18 | $TiSi_2$ | 80 | 0.00319 | 0.02418 | 10 | 90 |
| E19 | GHR8110 | 3 | PE/m-PE | 17 | $TiSi_2$ | 80 | 0.00312 | 0.02365 | 15 | 85 |
| E20 | GHR8110 | 4 | PE/m-PE | 16 | $TiSi_2$ | 80 | 0.00325 | 0.02463 | 20 | 80 |
| E21 | GHR8110 | 5 | PE/m-PE | 15 | $TiSi_2$ | 80 | 0.00332 | 0.02516 | 25 | 75 |
| E22 | GHR8110 | 6 | PE/m-PE | 14 | $TiSi_2$ | 80 | 0.00329 | 0.02493 | 30 | 70 |
| E23 | GHR8110 | 7 | PE/m-PE | 13 | $TiSi_2$ | 80 | 0.00336 | 0.02547 | 35 | 65 |
| E24 | GHR8110 | 8 | PE/m-PE | 12 | $TiSi_2$ | 80 | 0.00357 | 0.02706 | 40 | 60 |
| E25 | GHR8110 | 9 | PE/m-PE | 11 | $TiSi_2$ | 80 | 0.00412 | 0.03123 | 45 | 55 |
| E26 | GHR8110 | 10 | PE/m-PE | 10 | $TiSi_2$ | 80 | 0.00457 | 0.03464 | 50 | 50 |
| E27 | GUR4012 | 1 | PE/m-PE | 19 | $TiSi_2$ | 80 | 0.00378 | 0.02865 | 5 | 95 |
| E28 | GUR4012 | 2 | PE/m-PE | 18 | $TiSi_2$ | 80 | 0.00343 | 0.02600 | 10 | 90 |
| E29 | GUR4012 | 3 | PE/m-PE | 17 | $TiSi_2$ | 80 | 0.00338 | 0.02562 | 15 | 85 |
| E30 | GUR4012 | 4 | PE/m-PE | 16 | $TiSi_2$ | 80 | 0.00325 | 0.02463 | 20 | 80 |
| E31 | GUR4012 | 5 | PE/m-PE | 15 | $TiSi_2$ | 80 | 0.00331 | 0.02509 | 25 | 75 |
| E32 | GUR4012 | 6 | PE/m-PE | 14 | $TiSi_2$ | 80 | 0.00316 | 0.02395 | 30 | 70 |
| CE1 | — | | PE/m-PE | 20 | N525 | 80 | 0.00101 | 0.00765 | — | — |
| CE2 | — | | PE/m-PE | 20 | $TiSi_2$ | 80 | 0.00259 | 0.01963 | — | — |
| CE3 | GUR4120 | 2 | PE/m-PE | 18 | N525 | 80 | 0.00122 | 0.00925 | 10 | 90 |
| CE4 | GUR4120 | 2 | PE/m-PE | 18 | $TiSi_2$ | 80 | 0.00334 | 0.02531 | 10 | 90 |
| CE5 | GUR4170 | 2 | PE/m-PE | 18 | N525 | 80 | 0.00125 | 0.00947 | 10 | 90 |
| CE6 | GUR4170 | 2 | PE/m-PE | 18 | $TiSi_2$ | 80 | 0.00356 | 0.02698 | 10 | 90 |

Examples 2-10 (E2-E10)

The procedures and conditions in preparing the test samples of Examples 2-10 (E2-E10) were similar to those of Example 1, except that the amounts of the reinforcing polyolefin and the base polyolefin were different (as shown in Table 1) for each of Examples 1-10. The electrical properties of the test samples of Examples 2-10 were determined (as shown in Table 1).

Examples 11-16 (E11-E16)

The procedures and conditions in preparing the test samples of Examples 11-16 (E11-E16) were similar to those of Example 1 except for the reinforcing polyolefin employed. The reinforcing polyolefin employed for each of Examples 11-16 is available from Ticona company under a catalog no. GUR4012 (having a weight average molecular weight of 1,500,000 g/mole and a melt flow rate of 0.03 g/10 min according to ASTM 0-1238 under a temperature of 230° C. and a load of 12.6 Kg). The amounts of the reinforcing polyolefin employed for Examples 11-16 correspond to Examples 1-6, respectively (as shown in Table 1). The electrical properties of the test samples of Examples 11-16 were determined (as shown in Table 1).

Examples 17-26 (E17-E26)

The procedures and conditions in preparing the test samples of Examples 17-26 (E17-E26) were similar to those of Example 1, except that the particulate conductive filler 22 employed for Examples 17-26 was made from titanium disilicide. The amounts of the reinforcing polyolefin employed for Examples 17-26 correspond to Examples 1-10. The electrical properties of the test samples of Examples 17-26 were determined (as shown in Table 1).

Examples 27-32 (E27-E32)

The procedures and conditions in preparing the test samples of Examples 27-32 (E27-E32) were similar to those of Example 1, except that the reinforcing polyolefin employed for Examples 27-32 was GUR4012 and that the particulate conductive filler 22 employed for Examples 27-32 was made from titanium disilicide. The amounts of the reinforcing polyolefin employed for Examples 27-32 correspond to Examples 11-16. The electrical properties of the test samples of Examples 27-32 were determined (as shown in Table 1).

Comparative Examples 1-2 (CE1-CE2)

The procedures and conditions in preparing the test samples of Comparative Examples 1-2 (CE1-CE2) were similar to those of Example 1, except that the reinforcing polyolefin was not used in Comparative Examples 1-2 and that the particulate conductive filler employed for Comparative Example 2 was titanium disilicide. The composition of the PTC polymer material is shown in Table 1. The electrical properties of the test samples of Comparative Examples 1-2 were determined (as shown in Table 1).

Comparative Examples 3-4 (CE3-CE4)

The procedures and conditions in preparing the test samples of Comparative Examples 3-4 (CE3-CE4) were similar to those of Example 1 except for the reinforcing polyolefin employed. The reinforcing polyolefin employed for Comparative Examples 3-4 is available from Ticona company under a catalog no. GUR4120 (having a weight average molecular weight of 5, 000, 000 g/mole). Polymer GUR4120 did not melt in the measurement of the melt flow rate thereof according to ASTM D-1238 under a temperature of 230° C. and a load of 12.6 Kg. Hence, Polymer GUR4120 remained as powder dispersed in the melt of the primary polymer unit during the compounding process in preparation of the test samples of Comparative Examples 3-4. The particulate conductive filler employed for Comparative Example 4 is made from titanium disilicide. The compositions of the PTC polymer material of Comparative Examples 3-4 are shown in Table 1. The electrical properties of the test samples of Comparative Examples 3-4 were determined (as shown in Table 1).

Comparative Examples 5-6 (CE5-CE6)>

The procedures and conditions in preparing the test samples of Comparative Examples 5-6 (CE5-CE6) were similar to those of Example 1 except for the reinforcing polyolefin employed. The reinforcing polyolefin employed for Comparative Examples 5-6 is available from Ticona company under a catalog no. GUR4170 (having a weight average molecular weight of 10,000,000 g/mole). Polymer GUR4170 did not melt in the measurement of the melt flow rate thereof according to ASTM D-1238 under a temperature of 230° C. and a load of 12.6 Kg. Hence, Polymer GUR4170 remained as powder dispersed in the melt of the primary polymer unit during the compounding process in preparation of the test samples of Comparative Examples 5-6. The particulate conductive filler employed for Comparative Example 6 is made from titanium disilicide. The compositions of the PTC polymer material of Comparative Examples 5-6 are shown in Table 1. The electrical properties of the test samples of Comparative Examples 5-6 were determined (as shown in Table 1).

Comparative Examples 7-0 (CE7-CE8)

The procedures and conditions in preparing the test samples of Comparative Examples7-8 (CE7-CE8) were similar to those of Example 1 except for the compounding temperature. The compounding temperature employed for Comparative Examples 7-8 was under 150° C. Since the reinforcing polyolefin employed for Comparative Examples 7-B did not melt under 150° C. during compounding, the same remained as powder dispersed in the melt of the primary polymer unit. The particulate conductive filler employed for Comparative Example 8 is made from titanium disilicide. The compositions of the PTC polymer material of Comparative Examples 7-8 correspond to Examples 2 and 18, respectively. The electrical properties of the test samples of Comparative Examples 7-8 were determined.

Performance Test

The test samples of Examples 1-32 and Comparative Examples 1-8 were subjected to switching cycle test for determining the variation percent in resistance of each test sample, which is used as an indication of the electrical stability of the test sample. The switching cycle test was conducted under a voltage of 6 Vdc and a current of 50 A by switching on for 60 seconds and then off for 60 seconds for each cycle, and was performed for 7200 cycles. The resistances of each test sample before and after the switching cycle test were determined, and the variation percent in resistance of each test sample before and after the switching cycle test was determined. The performance test results are shown in FIGS. 2 to 8.

Figure 2:
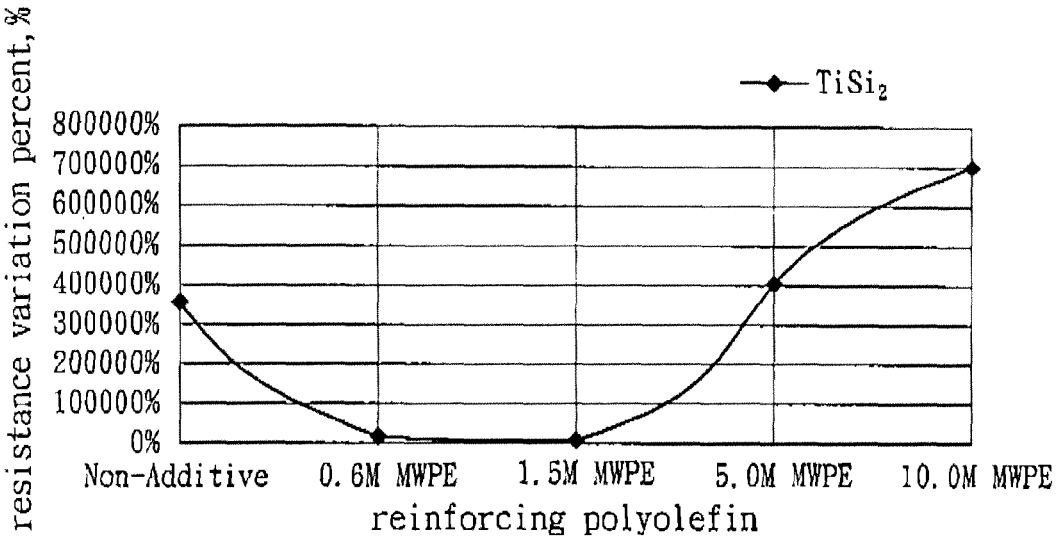
FIG. 2 is a plot showing the relationship between the variation percent in resistance and the weight average molecular weight of the reinforcing polyolefin for the test samples of Examples 17-32 and Comparative Examples 2, 4 and 6.

FIG. 2 (test samples having titanium disilicide) is a plot showing the relationship between the variation percent in resistance and the weight average molecular weight of the reinforcing polyolefin for the test samples of Examples 17-26 (with the reinforcing polyolefin having a weight average molecular weight of 0.6 M g/mole), Examples 27-32 (with the reinforcing polyolefin having a weight average molecular weight of 1.5 M g/mole), Comparative Example 2 (without the reinforcing polyolefin), Comparative Example 4 (with the reinforcing polyolefin having a weight average molecular weight of 5.0 M g/mole), and Comparative Example 6 (with the reinforcing polyolefin having a weight average molecular weight of 10.0 M g/mole).

Figure 3:
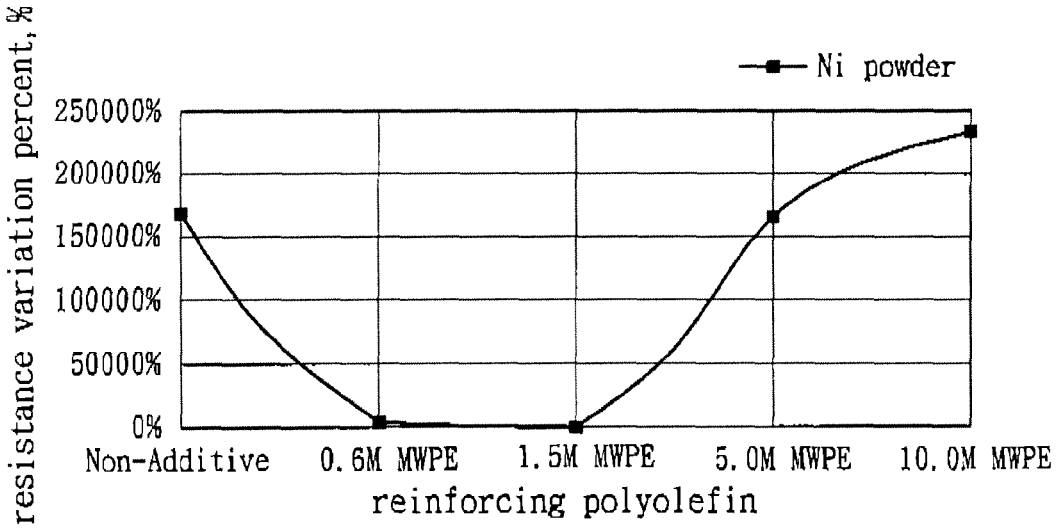
FIG. 3 is a plot showing the relationship between the variation percent in resistance and the weight average molecular weight of the reinforcing polyolefin for the test samples of Examples 1-16 and Comparative Examples 1, 3 and 5.

FIG. 3 (test samples having nickel powder) is a plot showing the relationship between the variation percent in resistance and the weight average molecular weight of the reinforcing polyolefin for the test samples of Examples 1-10 (with the reinforcing polyolefin having a weight average molecular weight of 0.6 M g/mole), Examples 11-16 (with the reinforcing polyolefin having a weight average molecular weight of 1.5 M g/mole), Comparative Example 1 (without the reinforcing polyolefin), Comparative Example 3 (with the reinforcing polyolefin having a weight average molecular weight of 5.0 M g/mole), and Comparative Example 5 (with the reinforcing polyolefin having a weight average molecular weight of 10.0 M g/mole).

FIGS. 2 and 3 show that the test samples exhibit a relatively lower resistance variation after the switching cycle test when the weight average molecular weight of the reinforcing polyolefin ranges from 0.6M to 1.5 M g/mole, The inventors found that, within the molecular weight range, the reinforcing polyolefin can be co-melted with the primary polymer unit to form the primary polymer unit into a uniform phase during compounding under 200° C., which permits improvement in the resistance variation as compared to the conventional PTC elements (without the reinforcing polyolefin). When beyond the molecular weight range (Comparative Examples 3-6), the reinforcing polyolefin cannot be co-melted with the primary polymer unit during compounding under 200° C. and remains as powder dispersed in the polymer matrix of the primary polymer unit, which results in an adverse effect on the electrical stability of the PTC element.

Figure 4:
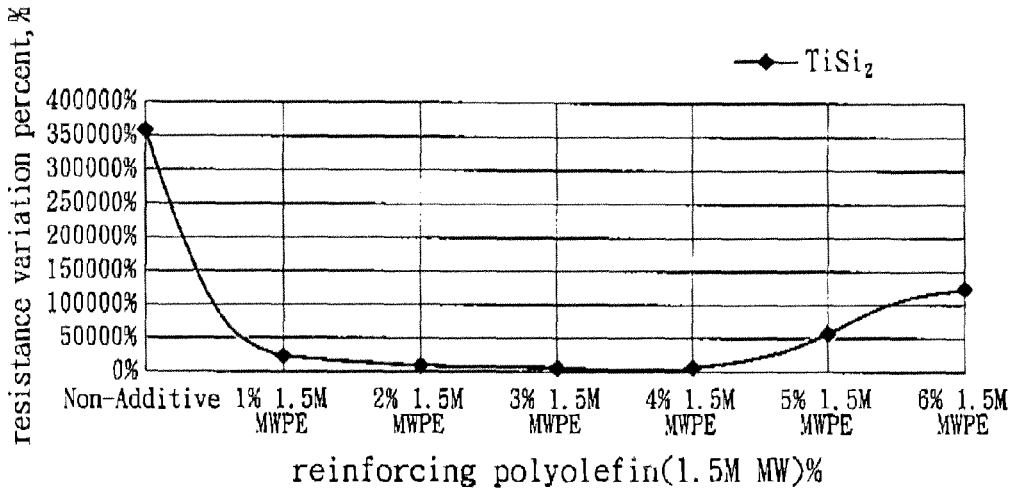
FIG. 4 is a plot showing the relationship between the variation percent in resistance and the weight percent of the reinforcing polyolefin (based on the weight of the polymer composition) for the test samples of Examples 27-32 and Comparative Example 2.

FIG. 4 (test samples having titanium disilicide) is a plot showing the relationship between the variation percent in resistance and the weight percent of the reinforcing polyolefin (based on the weight of the PTC polymer composition) for the test samples of Examples 27-32 (with the reinforcing polyolefin having a weight average molecular weight of 1.5 M g/mole) and Comparative Example 2 (without the reinforcing polyolefin).

Figure 5:
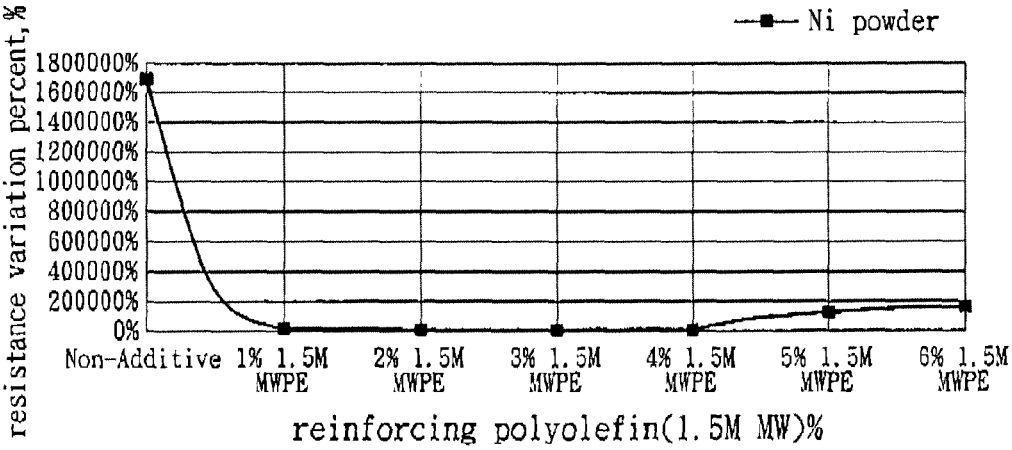
FIG. 5 is a plot showing the relationship between the variation percent in resistance and the weight percent of the reinforcing polyolefin (based on the weight of the polymer composition) for the test samples of Examples 11-16 and Comparative Example 1.

FIG. 5 (test samples having nickel powder) is a plot showing the relationship between the variation percent in resistance and the weight percent of the reinforcing polyolefin (based on the weight of the polymer composition) for the test samples of Examples 11-16 (with the reinforcing polyolefin having a weight average molecular weight of 1.5 M g/mole) and Comparative Example 1 (without the reinforcing polyolefin).

FIGS. 4 and 5 show that the test samples exhibit a relatively lower resistance variation after the switching cycle test when the weight percent of the reinforcing polyolefin ranges from 1 to 4 wt %.

Figure 6:
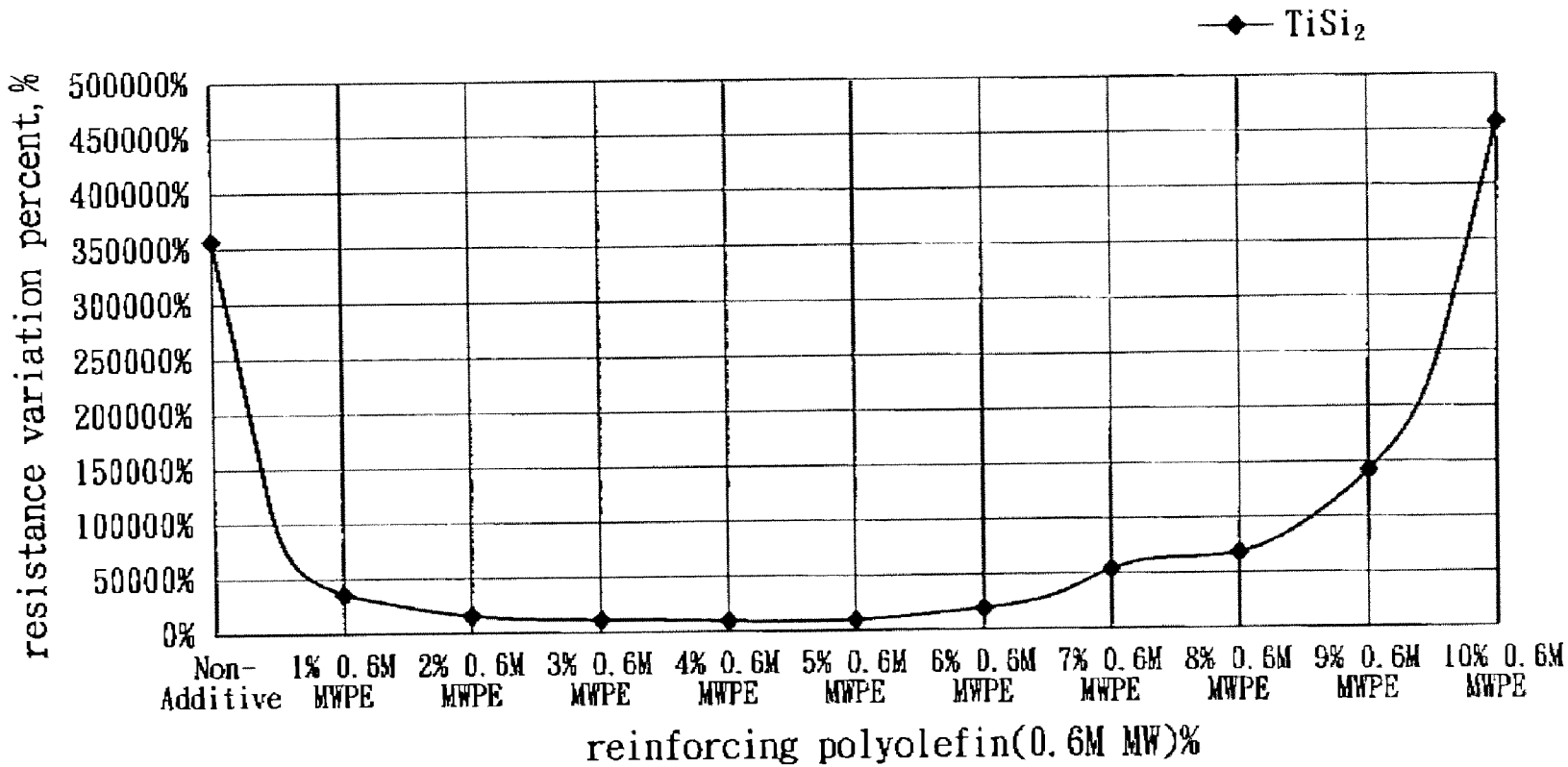
FIG. 6 is a plot showing the relationship between the variation percent in resistance and the weight percent of the reinforcing polyolefin (based on the weight of the polymer composition) for the test samples of Examples 17-26 and Comparative Example 2.

FIG. 6 (test samples having titanium disilicide) is a plot showing the relationship between the variation percent in resistance and the weight percent of the reinforcing polyolefin (based on the weight of the PTC polymer composition) for the test samples of Examples 17-26 (with the reinforcing polyolefin having a weight average molecular weight of 0.6 M g/mole) and Comparative Example 2 (without the reinforcing polyolefin).

Figure 7:
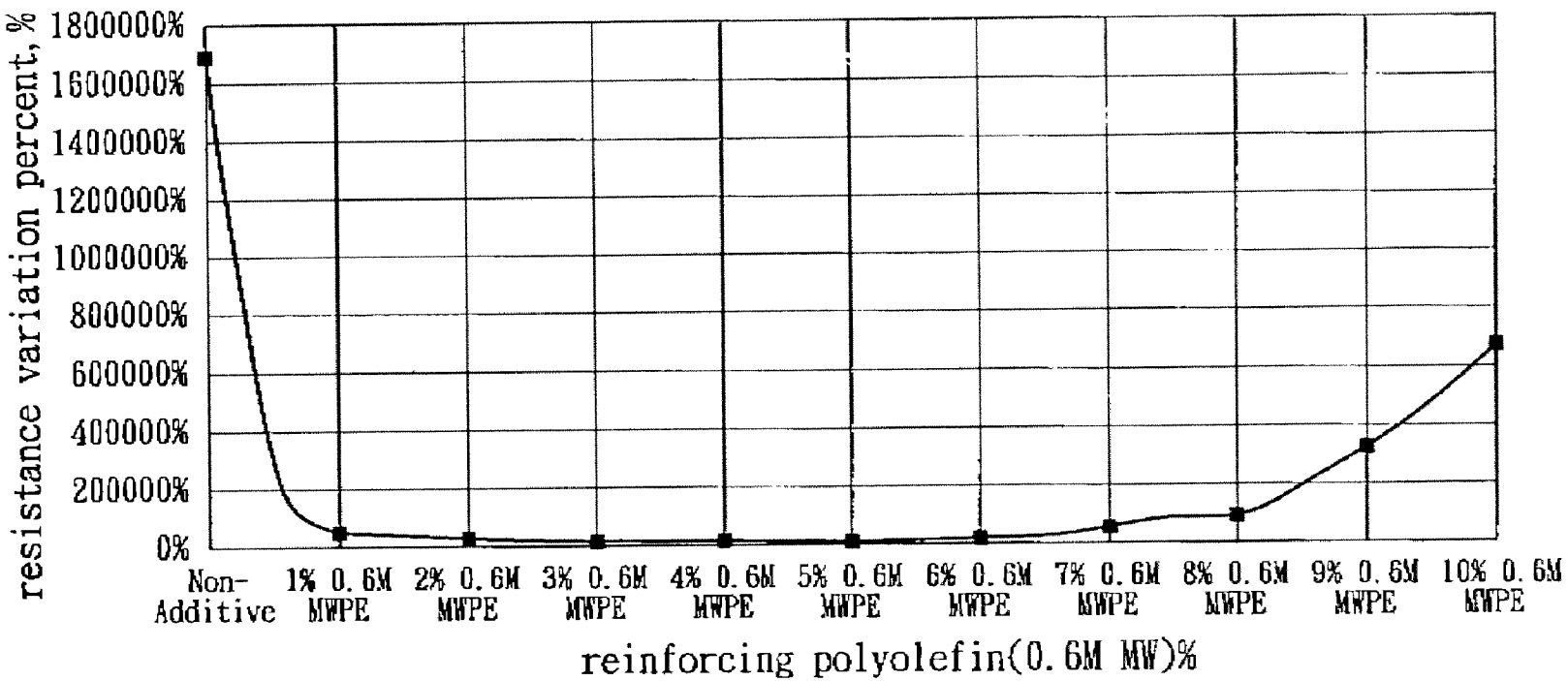
FIG. 7 is a plot showing the relationship between the variation percent in resistance and the weight percent of the reinforcing polyolefin (based on the weight of the polymer composition) for the test samples of Examples 1-10 and Comparative Example 1.

FIG. 7 (test samples having nickel powder) is a plot showing the relationship between the variation percent in resistance and the weight percent of the reinforcing polyolefin (based on the weight of the PTC polymer composition) for the test samples of Examples 1-10 (with the reinforcing polyolefin having a weight average molecular weight of 0.6 M g/mole) and Comparative Example 1 (without the reinforcing polyolefin).

FIGS. 6 and 7 show that the test samples exhibit a relatively lower resistance variation after the switching cycle test when the weight percent of the reinforcing polyolefin ranges from 1 to 6 wt %.

Figure 8:
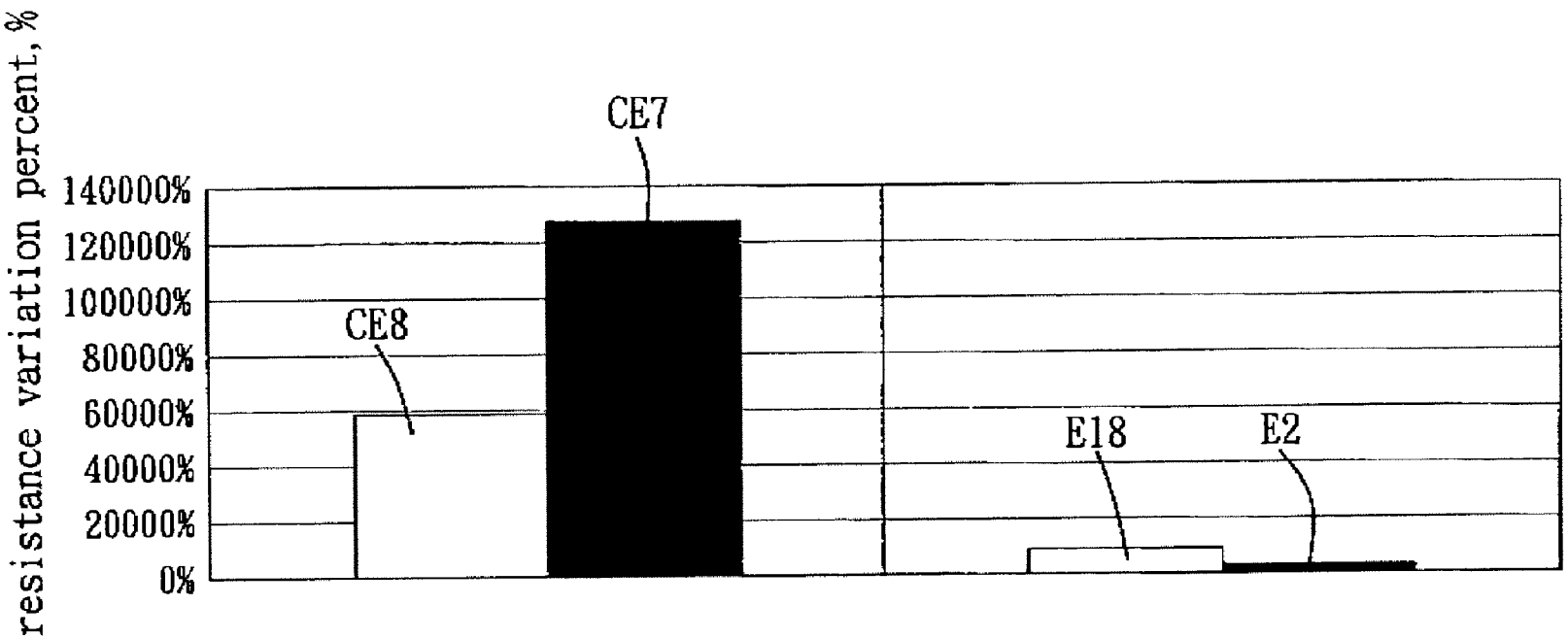
FIG. 8 is a plot showing the variation percent in resistance for the test samples of Examples 2 and 18 and Comparative Examples 7 and 8.

FIG. 8 is a plot showing the variation percent in resistance for the test samples of Examples 2 and 18 and Comparative Examples 7 and 8. The results show that Examples 2 and 18 (the reinforcing polyolefin is co-melted with the primary polymer unit during compounding) exhibit a much lower variation percent in resistance as compared to Comparative Examples 7 and 8 (the reinforcing polyolefin is not co-melted with the primary polymer unit during compounding).

In conclusion, with the inclusion of the reinforcing polyolefin in the polymer composition and by co-melting the reinforcing polyolefin with the primary polymer unit to form the PTC polymer material 2 of the PTC circuit protection device of the present invention, the aforesaid arc generating problem associated with the prior art due to replacement of carbon black with the non-carbon black conductive filler for low resistivity (less than 0.05 ohm-cm) applications can be eliminated.

While the present invention has been described in connection with what is considered the most practical and preferred embodiment, it is understood that this invention is not limited to the disclosed embodiment but is intended to cover various arrangements included within the spirit and scope of the broadest interpretation and equivalent arrangements.

What is claimed is:

1. A PTC circuit protection device comprising:

a PTC polymer material; and two electrodes attached to said PTC polymer material;

wherein said PTC polymer material includes a polymer matrix and a particulate conductive filler dispersed in said polymer matrix and having a resistivity less than that of carbon black;

wherein said polymer matrix is made from a polymer composition that contains at least a primary polymer unit and a reinforcing polyolefin, said primary polymer unit containing a base polyolefin and optionally a grafted polyolefin, said reinforcing polyolefin having a weight average molecular weight greater than that of said base polyolefin, said primary polymer unit and said reinforcing polyolefin being co-melted together and then solidified to form said polymer matrix;

wherein said base polyolefin has a melt flow rate ranging from 10 g/10 min to 100 g/10 min measured according to ASTM D-1238 under a temperature of 230° C. and a load of 12.6 Kg, and said reinforcing polyolefin has a melt flow rate ranging from 0.01 g/10 min to 1 g/10 min measured according to ASTM D-1238 under a temperature of 230° C. and a load of 12.6 Kg; and wherein said primary polymer unit is in an amount ranging from 50 to 95 wt % based on the weight of said polymer composition, and said reinforcing polyolefin is in an amount ranging from 5 to 50 wt % based on the weight of said polymer composition.

2. The PTC circuit protection device of claim 1, wherein the amount of said primary polymer unit ranges from 75 to 95 wt % based on the weight of said polymer composition and the amount of said reinforcing polyolefin ranges from 5 to 25 wt % based on the weight of said polymer composition.

3. The PTC circuit protection device of claim 1, wherein the weight average molecular weight of said reinforcing polyolefin ranges from 600,000 g/mole to 1,500,000 g/mole.

4. The PTC circuit protection device of claim 1, wherein the weight average molecular weight of said base polyolefin ranges from 50,000 g/mole to 300,000 g/mole.

5. The PTC circuit protection device of claim 1, wherein said particulate conductive filler is made from a material selected from a group consisting of titanium carbide, zirconium carbide, vanadium carbide, niobium carbide, tantalum carbide, chromium carbide, molybdenum carbide, tungsten carbide, titanium nitride, zirconium nitride, vanadium nitride, niobium nitride, tantalum nitride, chromium nitride, titanium disilicide, zirconium disilicide, niobiumdisilicide, tungstendisilicide, gold, silver, copper, aluminum, nickel, nickel-metallizedglass beads, nickel-metallized graphite, Ti—Ta solid solution, W—Ti-Ta—Cr solid solution, W—Ta solid solution, W—Ti-Ta—Nb solid solution, W—Ti-Ta solid solution, W—Ti solid solution, Ta—Nb solid solution, and combinations thereof.

6. The PTC circuit protection device of claim 5, wherein said particulate conductive filler is made from nickel or titanium disilicide.

7. The PTC circuit protection device of claim 1, wherein said base polyolefin and said reinforcing polyolefin are polyethylene.

8. The PTC circuit protection device of claim 1, wherein said PTC polymer material has a resistivity less than 0.05 ohm-cm.

9. The PTC circuit protection device of claim 1, wherein said reinforcing polyolefin is in an amount ranging from 0.5 to 10 wt % based on the weight of said PTC polymer material, said primary polymer unit is in an amount ranging from 5 to 20 wt % based on the weight of said PTC polymer material, and said particulate conductive filler is in an amount ranging from 70 to 90 wt % based on the weight of said PTC polymer material.

* * * * *